US005959522A

United States Patent [19]

Andrews

[11] Patent Number: 5,959,522

[45] Date of Patent: Sep. 28, 1999

[54] INTEGRATED ELECTROMAGNETIC DEVICE AND METHOD

[75] Inventor: James A. Andrews, Phoenix, Ariz.

[73] Assignee: Motorola, Inc., Schaumburg, Ill.

[21] Appl. No.: 09/017,929

[22] Filed: Feb. 3, 1998

[51] Int. Cl.[6] ..... H01F 5/00; H01F 27/28

[52] U.S. Cl. ..... 336/200; 336/223; 336/84 M

[58] Field of Search ..... 336/223, 200, 336/84 M

[56] References Cited

U.S. PATENT DOCUMENTS

| | | | |
|---|---|---|---|
| 3,614,554 | 10/1971 | Richardson et al. | 336/200 |
| 5,227,659 | 7/1993 | Hubbard | 257/531 |
| 5,345,194 | 9/1994 | Nagasako | 331/99 |
| 5,396,101 | 3/1995 | Shiga | 257/531 |
| 5,583,474 | 12/1996 | Mizoguchi et al. | 336/200 |
| 5,635,892 | 6/1997 | Ashby et al. | 336/200 |
| 5,717,249 | 2/1998 | Yoshikawa et al. | 257/728 |
| 5,861,336 | 1/1999 | Rddey et al. | 438/407 |

OTHER PUBLICATIONS

C. P. Yue et al., "On–Chip Spiral Inductors with Patterned Ground Shields for Si–Based RF IC's", Symposium on VLSI Circuits Digest of Technical Papers, Jun. 1997, pp. 85–86.

J. Craninckx; A 1.8–GHz Low–Phase–Noise CMOS VCO Using Optimized Hollow Spiral Inductors; IEEE Journal of Solid State Circuits, vol. 32, No. 5, May 1997, pp. 736–744.

*Primary Examiner*—Michael L. Gellner
*Assistant Examiner*—Anh Mai
*Attorney, Agent, or Firm*—Robert F. Hightower

[57] ABSTRACT

An integrated electromagnetic device (112) provides increased inductance in a smaller area on a semiconductor substrate (130). A conduction path (140) is disposed on the substrate for developing the inductance. A first magnetic shield (142) is disposed between the substrate and the conduction path to concentrate the magnetic flux induced by current flowing along the conduction path, which increases the inductance. Inductance is further increased by shielding the magnetic flux from the substrate with the first magnetic shield, which reduces substrate eddy currents that oppose the applied current. A second magnetic shield (144) overlaying the conduction path is coupled to the first magnetic shield, further concentrating the magnetic flux and increasing the inductance.

12 Claims, 3 Drawing Sheets

106

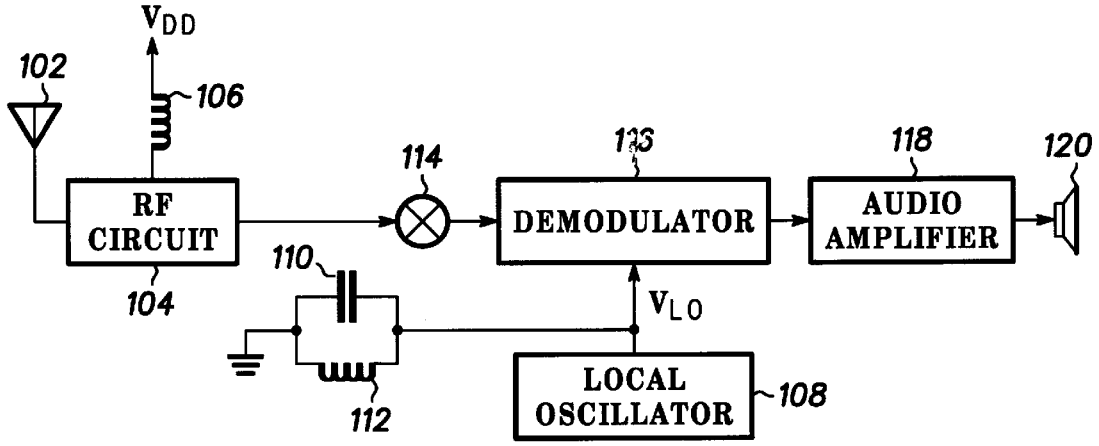
100 FIG. 1
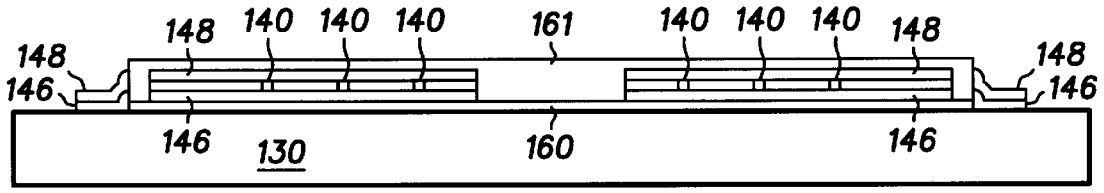
FIG. 3

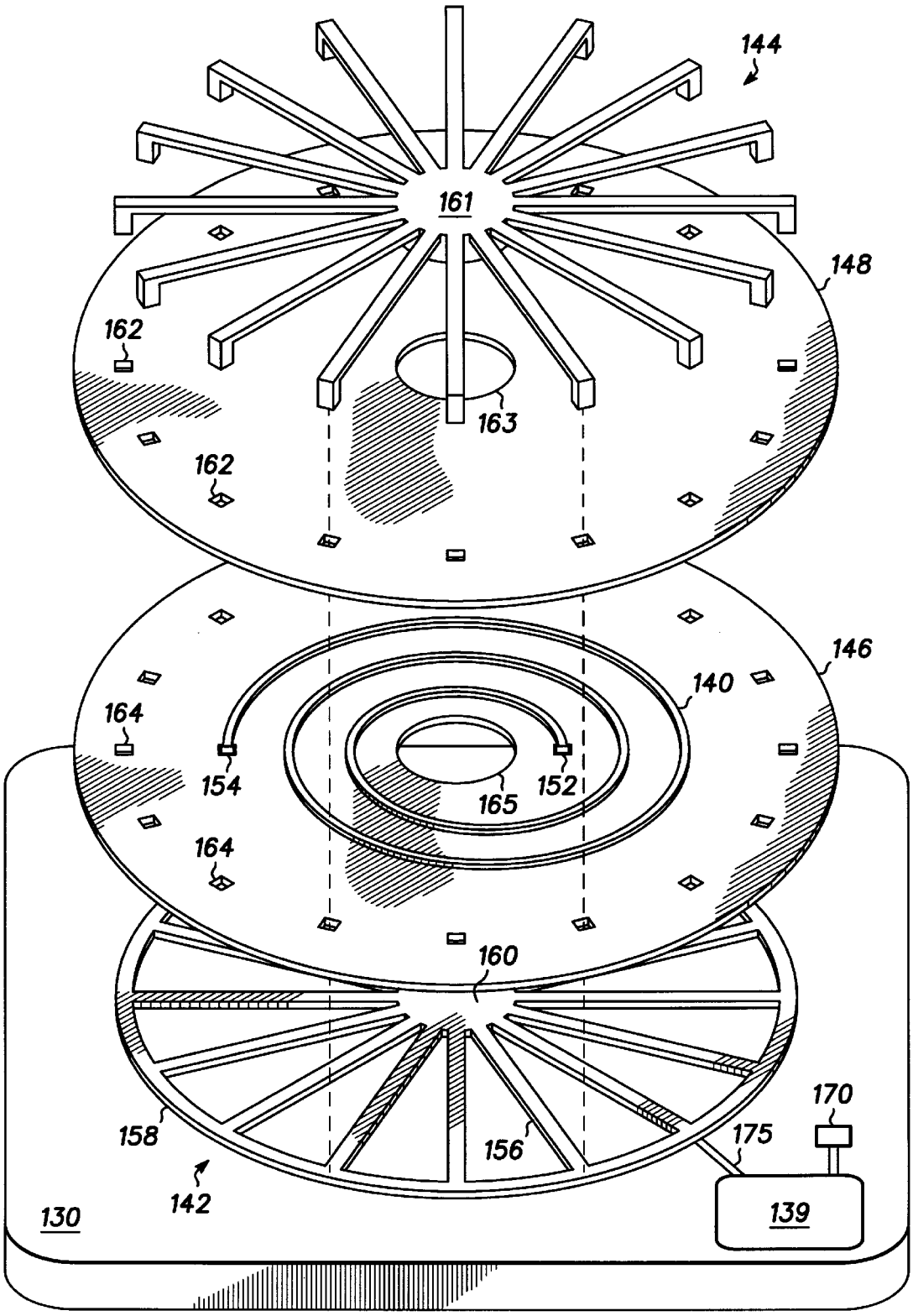
106 FIG. 2

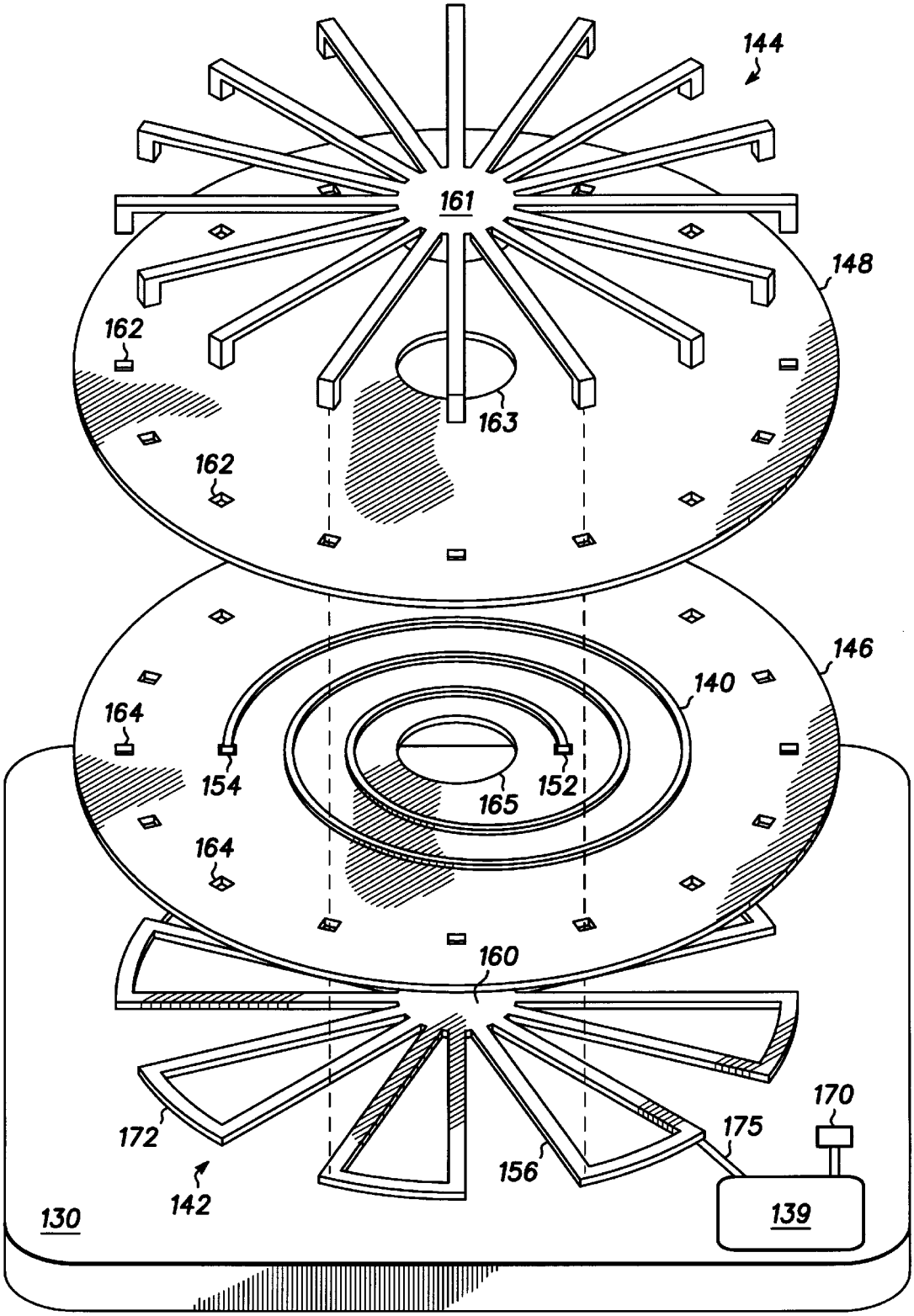
106 FIG. 4

INTEGRATED ELECTROMAGNETIC DEVICE AND METHOD

BACKGROUND OF THE INVENTION

The present invention relates in general to integrated circuits, and more particularly to electromagnetic devices fabricated on a dielectric substrate or semiconductor wafer.

Wireless communications devices are benefiting from advancements in semiconductor technology which have led to increased levels of integration and higher operating frequencies. For example, cellular telephones and pagers used these advancements to increase their functionality and reliability while reducing their physical size, power consumption and manufacturing cost. However, an obstacle to further integration is the inability to fabricate a cost effective inductor having a high inductance and quality factor ("Q") at frequencies greater than one gigahertz. Moreover, the growing use of filters in communications devices has increased the need for such an inductor which can be integrated on a dielectric or semiconductor substrate die with other circuitry.

Prior art integrated inductors typically consume a large substrate area in order to achieve adequate inductance values, which adds substantial cost to an integrated circuit. When high permeability materials are used to increase the inductance per unit area, the inductors suffer from an inadequate Q due to parasitic substrate eddy currents induced by the magnetic flux leakage at the periphery of the high permeability material.

Hence, there is a need for a high inductance, high Q inductor that can be integrated on a semiconductor die long with other circuitry.

BRIEF DESCRIPTION OF THE DRAWINGS

FIG. 1 is a schematic diagram of a portable wireless communications device;

FIG. 2 is an exploded isometric view of an integrated circuit including an inductor;

FIG. 3 is a cross-sectional view of the inductor; and

FIG. 4 is an exploded isometric view of an alternate embodiment of an inductor.

DETAILED DESCRIPTION OF THE DRAWINGS

In the figures, elements having the same reference number have similar functionality.

FIG. 1 is a block diagram of a portable wireless communications device 100 such as a cellular telephone, pager or two-way radio. A transceiver circuit in communications device 100 includes an antenna 102 and a radio frequency (RF) circuit 104. Antenna 102 receives a transmitted RF carrier signal modulated with incoming audio information. RF circuit 104 includes an amplifier stage to amplify the RF carrier signal to produce an amplified RF signal. An inductor 106 is coupled between the amplifier stage and a power supply conductor operating at a battery voltage $V_{DD}$=3.0 volts to operate as a filtering and load element for setting the gain of RF circuit 104. Where communications device 100 is a cellular telephone or a two-way radio, RF circuit 104 also includes a transmitter circuit that drives antenna 102 with a transmitted RF signal modulated with an outgoing audio signal and which may also include a filtering or gain-setting inductor to increase the amplitude of the RF carrier signal.

A local oscillator 108 generates a local oscillator signal $V_{LO}$ operating at a radio frequency for tuning communications device 100. Low noise operation is attained by filtering $V_{LO}$ using a tank circuit that includes a capacitor 110 and an inductor 112 to achieve a high degree of spectral purity at the resonant frequency.

A mixer 114 receives $V_{LO}$ and the amplified RF signal and produces an intermediate frequency signal which is applied to demodulator 116 for extracting the audio information. An audio amplifier 118 amplifies the audio information to produce an audio output signal for driving a speaker 120 or similar output device.

It should be appreciated that communications device 100 may include other inductors or other electromagnetic elements not shown or described above which operate as frequency selection or filtering devices in accordance with standard practices in the art. Wherever these devices may be used in communications device 100, they have a common purpose of providing an output signal having a sufficiently high amplitude along with low noise and low interference levels, and so are designated as gain setting devices. These devices often are integrated with other circuitry on a semiconductor die and have typical inductance values from 5–100 nanohenries.

FIG. 2 is an exploded isometric view of an integrated circuit including active circuitry 139 and an electromagnetic device functioning as inductor 112 integrated on a semiconductor substrate 130. It should be noted that the principles of the present invention can alternatively be applied to produce an electromagnetic device on a dielectric substrate such as a ceramic or fiberglass-epoxy substrate, either as a single component or integrated with other components, either active and/or passive. Such alternate embodiments are herein designated as integrated circuits. Inductor 112 includes a conduction path 140, a lower shielding layer 142, an upper shielding layer 144 and insulating layers 146 and 148. A similar structure is used to fabricate inductor 106 as well as most other inductors used in communications device 100, and can also be used to implement other types of integrated electromagnetic devices such as transformers and transmission lines. Inductor 112 is fabricated using hybrid integrated circuit or semiconductor manufacturing equipment and techniques.

Substrate 130 comprises a semiconductor material such as doped silicon. As explained in detail below, the operation of inductor 112 is substantially independent of the thickness and doping concentration of substrate 130. Consequently, substrate 130 is tailored to optimize the performance of active devices of the integrated circuit.

Conduction path 140 comprises an aluminum, copper, or other standard metal conductor with a planar spiral shape and having inner and outer electrodes 152 and 154 for applying a current that flows along conduction path 140. The current gives rise to a magnetic flux which causes conduction path 140 to operate as an inductor. It is evident that multiple conduction paths can be interleaved or otherwise close-coupled on the same metal layer or on separate metal layers to produce an electromagnetic element that operates as a transformer. The spiral shape induces a higher magnetic flux per substrate area than that produced by most other shapes. However, virtually any other shape can be used, depending on the shape of the available substrate area.

The innermost windings of a planar spiral conductor contribute only a small amount to an inductor's overall inductance because the inner windings are shorter and enclose smaller areas of magnetic flux. Moreover, the higher magnetic fields near the axis increase the series resistance of the inner windings by inducing eddy currents that circulate within the conductor and effectively crowd the applied current to one side. This effect is especially noticeable at frequencies above about one gigahertz, and disproportionately reduces the quality factor ("Q") of the inductor at high frequencies. To reduce this effect, one or more of the innermost windings are omitted from conduction path 140, which as a consequence has an open region at its center.

Lower and upper shielding layers 142 and 144 are comprised of a material having a high relative magnetic permeability. As used herein, a high permeability material is one having a relative magnetic permeability greater than about 1.1, where the benefits of the present invention are most readily discernible. Examples of high permeability materials include metals such as permalloy, iron, nickel, and cobalt, and dielectrics containing suspensions of these materials.

Lower shielding layer 142 is disposed on substrate 130 underlying conduction path 140, and may be either conductive or non-conductive. If lower shielding layer 142 is conductive, the magnetic material is deposited on substrate 130 to a desired thickness by sputtering, vapor deposition, or other standard hybrid integrated circuit or semiconductor process. Lower shielding layer 142 may alternatively be made non-conductive by depositing particles of the high permeability material for suspending in an insulator such as silicon dioxide or silicon nitride. Typically, lower shielding layer 142 has a thickness of about ten microns.

As a current I flows along conduction path 140, a magnetic flux $\Phi_B$ is produced, most of which is concentrated in lower shielding layer 142, owing to its high permeability. As a result, $\Phi_B$ is increased in the region of conduction path 140, which increases the inductance L of inductor 112 in accordance with the equation $L^*I=\Phi_B$. This effect shields the magnetic flux from substrate 130, thereby avoiding the substrate eddy currents characteristic of many prior art inductors whose structures allow more of the magnetic flux to penetrate into the substrate. These eddy currents flow in a direction opposite to that of the primary current and induce an opposing magnetic flux that reduces the total magnetic flux and effective inductance of the inductor. The eddy currents have an additional drawback of reducing efficiency by dissipating power in the substrate.

When lower shielding layer 142 is conductive, the flux concentration induces eddy currents that circulate in lower shielding layer 142 in a direction opposite to that of the applied current flowing along conduction path 140. The eddy currents also induce an opposing magnetic flux which is coupled from lower shielding layer 142 to conduction path 140 to reduce the effective inductance of inductor 112. To reduce these eddy currents, lower shielding layer 142 is patterned with openings 156 running perpendicular to the direction of applied current to interrupt the current paths of the eddy currents. In the embodiment shown in FIG. 2, where conduction path 140 is formed as a circular spiral, openings 156 project radially from the axis of conduction path 140 so as to be perpendicular to the windings of conduction path 140. Such patterning can produce as much as an eightfold increase in the effective inductance as compared with prior art inductors using an unpatterned lower shielding layer. Openings 156 have an additional benefit of reducing the area of lower shielding layer 142, which reduces the parasitic substrate capacitance of inductor 112 and increases its maximum operating frequency.

A core region 160 of lower shielding layer 142 forms a high permeability hub centered on the axis of conduction path 140 to further concentrate the magnetic flux. The absence of inner windings of conduction path 140 reduces the need to curtail eddy currents in core region 160, which consequently is formed as a continuous region of high permeability material. Therefore, the radial projections of lower shielding layer 142 can be coupled to core region 160 and to a power supply conductor 175 operating at ground potential to shield substrate 130 from electric fields produced by voltage swings of inductor 112. Such electric field shielding provides more consistent control over the operation of inductor 112 and prevents dissipative resistive currents in substrate 130 that reduce the effective Q of inductor 112 and inject noise into nearby circuitry. When inductor 112 experiences large voltage swings, especially at high frequencies above 1.0 gigahertz, electrical shielding is improved by using an annular ring 158 to establish a constant potential throughout lower shielding layer 142.

If lower shielding layer 142 is made non-conductive, the magnetic flux is shielded from substrate 130 as described above to prevent substrate eddy currents from circulating. Moreover, because lower shielding layer 142 is non-conductive, there is no conductive path to support the flow of eddy currents within lower shielding layer 142. Consequently, a non-conductive lower shielding layer 142 increases the inductance while allowing substrate 130 to be formed to virtually any thickness and resistivity, thereby allowing a wider variety of circuits to be integrated on the die with inductor 112.

Insulating layers 146 and 148 are deposited between conduction path 140 and lower and upper shielding layers 142 and 144, respectively, to electrically isolate conduction path 140 from lower and upper shielding layers 142 and 144. Openings 162 and 164 are formed in insulating layers 146 and 148 as shown for coupling shielding layers 142 and 144 together. A standard semiconductor dielectric material such as silicon dioxide or silicon nitride is typically used to form insulating layers 146 and 148. When electrical isolation is not needed, such as when shielding layers 142 and 144 are non-conductive, insulating layers 146 and 148 are not used.

Upper shielding layer 144 overlies conduction path 140 and insulating layer 148 and has a high permeability composition similar to that of lower shielding layer 142. Upper shielding layer 144 has a similar pattern as that of lower shielding layer 142 and performs a similar function of concentrating the magnetic flux induced by current flowing along conduction path 140 to increase the inductance of inductor 112. As a feature of the present invention, upper shielding layer 144 is coupled to lower shielding layer 142 through openings 162 and 164 of insulating layers 146 and 148 to enclose conduction path 140 with a continuous magnetic shield in a direction perpendicular to and surrounding the applied current flowing along conduction path 140.

A core region 161 of upper shielding layer 144 is deposited through openings 163 and 165 to couple with core region 160. When shielding layers 142 and 144 are made conductive, this structure functions as a continuous electrical shield that encloses conduction path 140 as well as a magnetic shield.

FIG. 3 is a cross-sectional view of inductor 112 showing upper shielding layer 144 disposed through holes 162 and 164 of insulating layers 148 and 146, respectively, to couple with lower shielding layer 144. Such coupling between shielding layers 142–144 encloses or surrounds conduction path 140 with high permeability material to concentrate the magnetic flux, which increases the inductance of inductor 112, shields substrate 130 and other electronic circuitry 139 from magnetic and electric fields produced by inductor 112, and renders inductor 112 less susceptible to noise due to voltage variations coupled from nearby conductors.

FIG. 4 is an exploded isometric view of inductor 112 in an alternate embodiment. This embodiment is similar to the embodiment of FIG. 2 except that annular ring 158, which runs parallel to conduction path 140 and consequently supports the flow of eddy currents, is replaced by alternating shorting strips 172 to break the path of eddy currents while still maintaining a constant potential throughout lower shielding layer 142. The eddy currents flowing within a shorting strip 172 are reduced because of the shorter lengths of shorting strips 172 as compared with the length of annular ring 158.

Prior art inductors that provide shielding layers above and below the inductor's conduction path do not couple the layers together to enclose the conduction path with high permeability material. Consequently, a portion of the inductor's magnetic flux and electric field can leak around the edges of the shielding layers and penetrate the substrate, thereby inducing substrate eddy currents and reducing the effective inductance as described above. These prior art inductors attempt to reduce the eddy currents by extending the shielding layers well beyond the perimeter of the conduction path, which consumes die area and increases cost. The present invention avoids this problem by coupling lower and upper shielding layers 142–144 together to enclose conduction path 140 with a continuous high permeability material that shields the substrate from magnetic flux and electric field leakage to effectively reduce or eliminate such parasitic currents.

Hence, the present invention provides an improved integrated electromagnetic device and method which increases inductance of the electromagnetic device. A conduction path is disposed on a semiconductor substrate for developing the inductance across first and second terminals. A first magnetic shield disposed between the semiconductor substrate and the conduction path concentrates the magnetic flux induced by a current applied along the conduction path. A second magnetic shield overlays the conduction path and is coupled to the first magnetic shield to enclose the conduction path. The magnetic shields increase the inductance by preventing the magnetic flux from penetrating the substrate to generate substrate eddy currents that oppose the applied current. By enclosing the conduction path with a magnetic shield, a high performance electromagnetic device is provided in a smaller die area than prior art devices. The electromagnetic device can be fabricated on a semiconductor die and on a broad variety of substrate types without degrading its operation. Hence, the invention facilitates system design by allowing the substrate to be selected to improve the performance of other devices and circuitry integrated on the same die without degrading the electromagnetic device.

I claim:

1. An electromagnetic device, comprising:

a substrate;

a conduction path overlaying the substrate and having first and second electrodes for developing an inductance of the electromagnetic device;

a first magnetic shield disposed between the substrate and the conduction path wherein an opening is formed in the first magnetic shield and wherein the opening is suitable for running perpendicular to any applied current flow to reduce any eddy current within the first magnetic shield; and a second magnetic shield overlaying the conduction path and coupled to the first magnetic shield to enclose the conduction path wherein the first and second magnetic shields are suitable to increase magnetic fields generated by current flow along the conduction path.

2. The electromagnetic device of claim 1, wherein the substrate comprises a semiconductor substrate.

3. The electromagnetic device of claim 2, wherein the electromagnetic device is formed on an integrated circuit.

4. The electromagnetic device of claim 1, wherein the conduction path is formed as a planar spiral and the opening is defined by first and second projections of the first magnetic shield that are disposed radially from an axis of the planar spiral.

5. The electromagnetic device of claim 4, wherein an opening of the second magnetic shield is defined by first and second projections of the second magnetic shield that are disposed radially from the axis of the planar spiral to reduce an eddy current in the second magnetic shield induced by the magnetic flux.

6. The electromagnetic device of claim 5, wherein the first and second magnetic shields are coupled for receiving a power supply voltage to maintain the first and second magnetic shields at a constant potential.

7. The electromagnetic device of claim 1, wherein the first and second magnetic shields are conductive, further comprising:

a first dielectric layer disposed for electrically isolating the first magnetic shield from the conduction path; and a second dielectric layer disposed for electrically isolating the second magnetic shield from the conduction path.

8. The electromagnetic device of claim 1, wherein the electromagnetic device operates as an inductor, a transformer or a transmission line.

9. The electromagnetic device of claim 1, wherein the first magnetic shield has a relative permeability greater than 1.1 and the second magnetic shield has a relative permeability greater than 1.1.

10. The electromagnetic device of claim 9, wherein the first and second magnetic shields include iron, nickel, cobalt or permalloy.

11. An electromagnetic device, comprising:

a semiconductor substrate;

a conduction path overlaying the semiconductor substrate and having first and second electrodes for receiving an applied current to develop an inductance of the electromagnetic device; and a magnetic shield disposed between the semiconductor substrate and the conduction path and patterned with an opening that runs perpendicular to the applied current to reduce an eddy current in the semiconductor substrate.

12. The electromagnetic device of claim 9, wherein the conduction path is formed as a planar spiral and the opening is defined by first and second portions of the magnetic shield that are disposed radially from an axis of the planar spiral.

* * * * *

UNITED STATES PATENT AND TRADEMARK OFFICE

CERTIFICATE OF CORRECTION

PATENT NO. : 5,959,522
DATED : September 28, 1999
INVENTOR(S) : James A. Andrews It is certified that error appears in the above-identified patent and that said Letters Patent is hereby corrected as shown below:

Column 6,
Line 58, delete "9" and replace with -- 11 --.

Signed and Sealed this

Fourteenth Day of May, 2002

*Attest:*

*Attesting Officer*

JAMES E. ROGAN
*Director of the United States Patent and Trademark Office*